US008905240B2

(12) United States Patent
Park

(10) Patent No.: US 8,905,240 B2
(45) Date of Patent: Dec. 9, 2014

(54) DRY NAIL APPLIQUE PACKAGING SYSTEM

(71) Applicant: Park Global Holdings, LLC, Clifton, NJ (US)

(72) Inventor: Fa Young Park, Clifton, NJ (US)

(73) Assignee: Park Global Holdings, LLC, Clifton, NJ (US)

( * ) Notice: Subject to any disclaimer, the term of this patent is extended or adjusted under 35 U.S.C. 154(b) by 0 days.

(21) Appl. No.: 13/804,139

(22) Filed: Mar. 14, 2013

(65) Prior Publication Data

US 2014/0020700 A1 Jan. 23, 2014

Related U.S. Application Data

(60) Provisional application No. 61/674,693, filed on Jul. 23, 2012.

(51) Int. Cl.

| | |
|---|---|
| ***B65D 25/54*** | (2006.01) |
| ***A45D 29/18*** | (2006.01) |
| ***A45D 29/00*** | (2006.01) |
| ***B65B 5/06*** | (2006.01) |
| ***B65D 5/42*** | (2006.01) |
| *A45D 29/04* | (2006.01) |

(52) U.S. Cl.

CPC ..... *A45D 29/001* (2013.01); *A45D 29/18* (2013.01); *B65B 5/06* (2013.01); *B65D 2203/00* (2013.01); *A45D 29/04* (2013.01); *A45D 2029/005* (2013.01); *B65D 5/4204* (2013.01); *B65D 25/54* (2013.01)

USPC ..... 206/779; 206/730; 206/581; 206/776

(58) Field of Classification Search

USPC ..... 206/779, 462, 777, 776, 780, 775, 471, 206/730, 733, 734, 581; 132/75

See application file for complete search history.

(56) References Cited

U.S. PATENT DOCUMENTS

| | | | | |
|---|---|---|---|---|
| 2,727,620 A | | 12/1955 | Buttery | |
| 3,369,660 A | * | 2/1968 | Hartman | 206/294 |
| 3,656,612 A | | 4/1972 | Sellors | |
| 3,675,763 A | | 7/1972 | Sandel | |

(Continued)

FOREIGN PATENT DOCUMENTS

| | | |
|---|---|---|
| EP | 1477412 A1 | 11/2004 |
| EP | 1502862 B1 | 3/2006 |

(Continued)

OTHER PUBLICATIONS

Non-final Office Action for U.S. Appl. No. 13/344,698, mailed Dec. 11, 2012.

(Continued)

*Primary Examiner* — Steven A. Reynolds

(74) *Attorney, Agent, or Firm* — Carrie Stroup

(57) ABSTRACT

A package for nail polish appliqués includes a carton having a front wall defining an aperture therein, and an insert sized and shaped to fit inside the carton. The insert has a front wall and a window that projects outwardly from its front wall and through the aperture of the carton when the insert is inserted into the carton. The insert contains a packet of nail polish appliqués, and an object that displays a design corresponding to the design of the nail polish appliqués, wherein the object is displayed through the window. A method for assembling the package is also disclosed.

13 Claims, 4 Drawing Sheets

(56) References Cited

U.S. PATENT DOCUMENTS

| | | | | |
|---|---|---|---|---|
| 3,682,297 | A | 8/1972 | Austin et al. | |
| 3,819,035 | A | 6/1974 | Jaeschke | |
| 3,982,551 | A * | 9/1976 | Bartolucci | 132/73 |
| 4,106,614 | A * | 8/1978 | Aylott | 206/581 |
| 4,146,128 | A | 3/1979 | Hogg | |
| 4,180,165 | A * | 12/1979 | Kuchenbecker | 206/461 |
| 4,361,226 | A | 11/1982 | Travis | |
| 4,415,079 | A | 11/1983 | Ackeret | |
| 4,739,353 | A * | 4/1988 | Heuer et al. | 206/316.2 |
| 4,925,023 | A | 5/1990 | Goldblatt et al. | |
| 5,184,724 | A | 2/1993 | Mayled | |
| 5,396,985 | A | 3/1995 | Seki | |
| 5,409,105 | A | 4/1995 | Appelbaum et al. | |
| 5,944,183 | A | 8/1999 | Rowland et al. | |
| 6,758,340 | B1 | 7/2004 | Feibelman | |
| 7,070,055 | B2 * | 7/2006 | Lechanoine et al. | 206/581 |
| 7,389,876 | B2 * | 6/2008 | Hong et al. | 206/581 |
| 7,513,369 | B1 * | 4/2009 | Lee | 206/779 |
| 7,628,278 | B2 * | 12/2009 | Coppola | 206/733 |
| 7,874,430 | B2 * | 1/2011 | Anderson et al. | 206/733 |
| 8,061,364 | B2 | 11/2011 | Park | |
| 8,511,467 | B2 * | 8/2013 | Sorrentino et al. | 206/362.4 |
| 2005/0045526 | A1 | 3/2005 | Constant et al. | |
| 2005/0150508 | A1 | 7/2005 | Downs | |
| 2005/0199253 | A1 * | 9/2005 | Fiore et al. | 132/73 |
| 2006/0113215 | A1 * | 6/2006 | Clements et al. | 206/779 |
| 2006/0266672 | A1 | 11/2006 | Young | |
| 2007/0025936 | A1 | 2/2007 | Park | |
| 2007/0151898 | A1 * | 7/2007 | Coppola | 206/733 |
| 2007/0235051 | A1 * | 10/2007 | Robinson | 132/73.5 |
| 2008/0264436 | A1 * | 10/2008 | Fracassi et al. | 132/73 |
| 2008/0283073 | A1 | 11/2008 | Park | |
| 2010/0133139 | A1 * | 6/2010 | Lowe | 206/534 |
| 2012/0061290 | A1 | 3/2012 | Delaunay et al. | |
| 2012/0103865 | A1 | 5/2012 | Park | |
| 2012/0305016 | A1 | 12/2012 | Park | |

FOREIGN PATENT DOCUMENTS

| | | | |
|---|---|---|---|
| FR | 2689097 | A1 | 10/1993 |
| FR | 2782308 | A1 | 2/2000 |
| JP | 10-095421 | A | 4/1998 |

OTHER PUBLICATIONS

International Search Report and Written Opinion for International Patent Application No. PCT/US2013/036963, issued on Jul. 9, 2013.

Lacquerized—A blog about nail polish "Review: Essence Studio Nails—Nail Fashion Stickers" [Online] Sep. 25, 2010; Retrieved from Internet: URL: http://www.lacquerized.com/2010/09/review-essence-studio-nails-nail.html [retrieved on Aug. 7, 2013].

* cited by examiner

DRY NAIL APPLIQUE PACKAGING SYSTEM

RELATED APPLICATION

The present application claims priority to U.S. Provisional Patent Application Ser. No. 61/674,693, filed Jul. 23, 2012, the disclosure of which is incorporated by reference herein in its entirety.

BACKGROUND OF THE INVENTION

Nail polish appliqués, which are strips of partially cured nail polish, have become a common method of applying nail polish. Such nail appliqués are made of real nail polish, but rather than being applied as a liquid with a brush, the appliqués are partially cured strips of nail enamel which are applied to fingernails and fully cure thereon.

The dry nail polish appliqués are functionally equivalent to their counterpart bottled liquid nail polish and as such they are sold together with other nail polish bottles at retail locations. The spaces allotted to nail products in retail stores typically consist of narrow racks or shelves that are sized to receive average sized nail polish bottles. It has therefore been a challenge to package appliqués in a manner in which they may be displayed in these narrow racks at retail establishments.

SUMMARY OF THE INVENTION

The invention described herein is a novel system for packaging and displaying appliqués. The inventive package includes a carton that fits in conventional nail polish racks, and an insert within the carton that contains a packet of appliqués and implements for use with same (e.g., an emery board, nail file and/or cuticle pusher).

The present invention is directed towards a package that includes a carton having a front wall defining an aperture therein, and an insert that is sized and shaped to fit inside the carton. The insert has a front wall and a window projecting outwardly from the front wall of the insert, such that the window projects through the aperture when the insert is inserted into the carton. The window may display a nail polish appliqué design that corresponds to nail polish appliqués that are contained within the package.

The present invention is also directed towards a method for assembling a package. The assembly method includes the steps of (1) providing a carton having a bottom flap and a front wall connected to the bottom flap, the front wall defining an aperture therein; (2) placing at least one object inside an insert, the insert having a front wall and a window projecting outwardly therefrom; and (3) inserting the insert into the carton, wherein the insert is sized and shaped to fit inside the carton, such that the window projects through the aperture.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

DETAILED DESCRIPTION OF THE INVENTION

Detailed embodiments of the present invention are disclosed herein. It should be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, and some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as examples for teaching one skilled in the art to variously employ the present invention.

Figure 1:
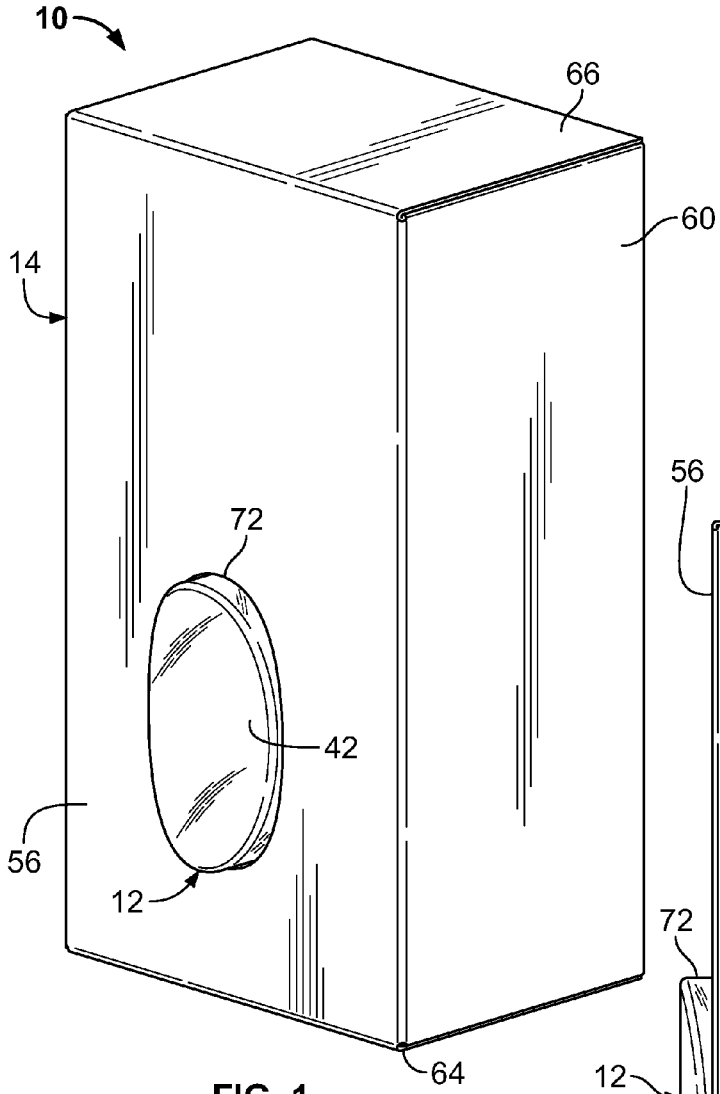
FIG. 1 is a top perspective view of an assembled package according to an embodiment of the present invention.
Figure 2:
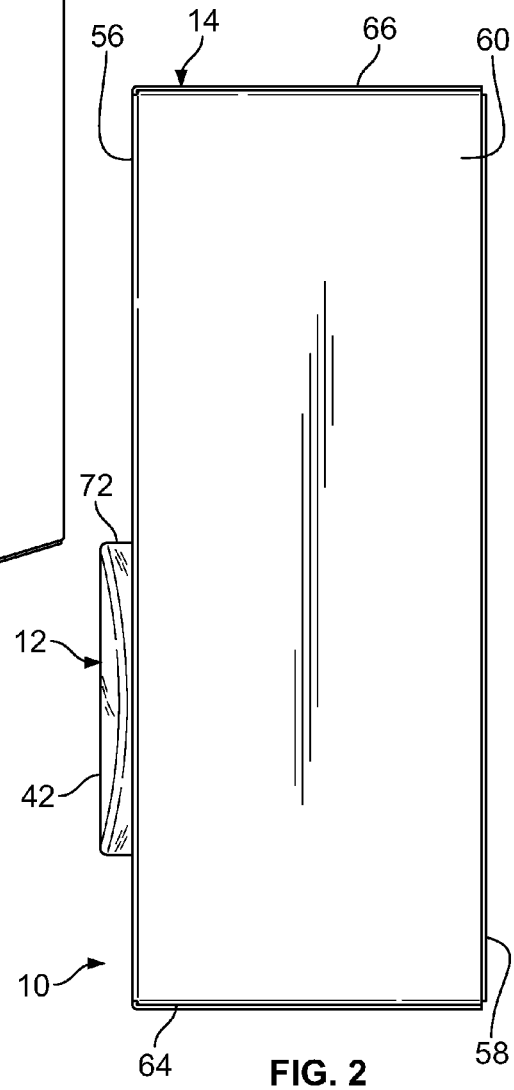
FIG. 2 is a side elevational view of the assembled package illustrated in FIG. 1.
Figure 5:
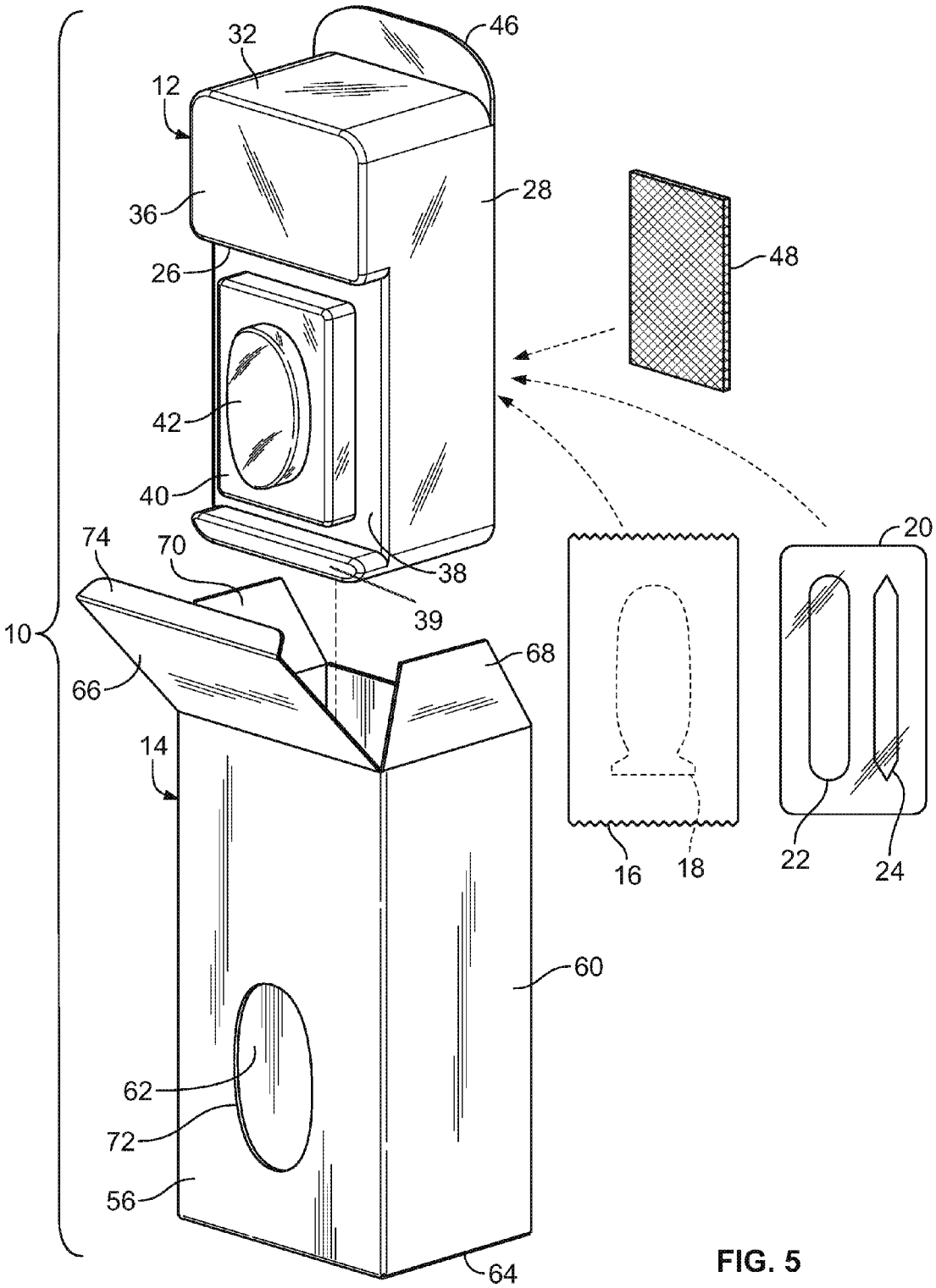
FIG. 5 is an exploded view of the package illustrated in FIGS. 1 and 2.

Reference is made to FIGS. 1, 2 and 5, which illustrate an embodiment of the assembled package 10 of the present invention. The package 10 includes an insert 12 (see also FIG. 3) and a carton 14 that is configured to receive the insert 12 therein. The insert 12 is sized and shaped so as to receive a packet 16 of nail polish appliqués 18 and an envelope 20 containing implements for use in applying the nail polish appliqués, such as an emery board or nail file 22 and a cuticle pusher 24 (see FIG. 5). The contents of the insert 12 are further discussed below.

Figure 3:
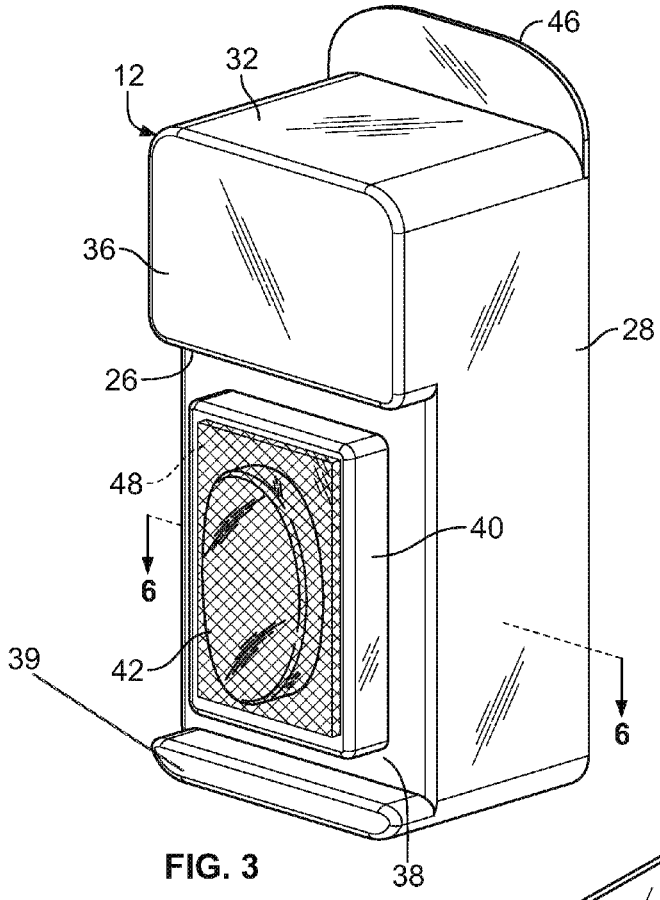
FIG. 3 is top perspective view of an insert of the package illustrated in FIGS. 1 and 2, as positioned vertically.
Figure 4:
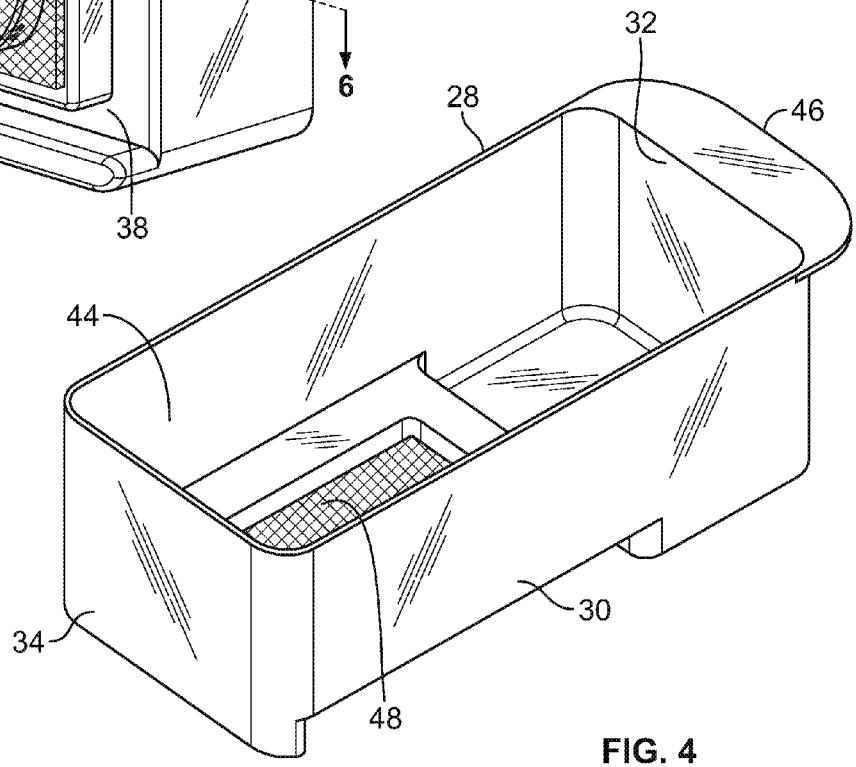
FIG. 4 is a top perspective view of the insert illustrated in FIG. 3, as positioned horizontally.

The insert 12 is shown separate from the carton 14 in FIGS. 2, 3 and 4. The insert 12 is substantially parallelepiped-shaped. In one embodiment, the insert 12 is substantially rectangular cuboid-shaped, wherein it has an elongated front wall 26, opposed elongated sidewalls 28, 30, and opposed top and bottom walls 32, 34. In one embodiment, the front wall 26 includes an upper portion 36, a recessed intermediate portion 38 and a lower portion 39. A raised panel 40 extends outwardly from a plane defined by the intermediate portion 38, and has a hollow interior 41 (see FIG. 6). A window 42 projects outwardly from the raised panel 40 and defines an interior space 43 (see FIG. 6) that is continuous with the hollow interior 41 of the raised panel 40. The raised panel 40 is therefore proximate the window 42. As illustrated in FIGS. 1-3 and 5, the raised panel 40 is substantially rectangular cuboid-shaped and the window 42 is substantially ellipsoid-shaped. However, the raised panel 40 and/or the window 42 may have different shapes in other embodiments of the invention. In another embodiment, the front wall 26 does not include a raised panel, and the window 42 projects outwardly directly from the front wall 26. The raised panel 40 and the window 42 are further discussed below.

As best shown in FIG. 4, the rear side of the insert 12 (i.e., opposite the front wall 26) is open, and the front wall 26, sidewalls 28, 30, and top and bottom walls 32, 34 define a cavity 44 that is accessible via the open rear side of the insert 12. The cavity 44 may be used to contain various items sold in the package 10, such as the packet 16 of appliqués 18 and the implement envelope 20 illustrated in FIG. 5. The cavity 44 is continuous with the hollow interior 41 of the raised panel 40 and the interior space 43 of the window 42. In another embodiment, the insert 12 includes at least a rear wall segment with a window or cutout that allows access to the cavity 44.

In one embodiment, the insert 12 is made of a rigid, yet somewhat flexible plastic material. A pull tab 46 extends from the rear edge of the top wall 32 of the insert 12 (i.e., the edge farthest from and opposite to the front wall 26). The flexible plastic of the insert 12 allows a user to rotate the pull tab 46 from a first position, in which it is substantially perpendicular to the top wall 32 (see FIGS. 3 and 5), to a second position, in which it is substantially parallel to the top wall 32 and may overlie the top wall 32. The pull tab 46 is further discussed below.

Reference is now made to FIGS. 3 and 5, wherein the raised panel 40 and the window 42 are illustrated as being integrally formed on the intermediate portion 38 of the front wall 26. In one embodiment, the entire insert 12, including the raised panel 40 and the window 42, is formed as a monolithic unit using techniques known in the art (e.g., stamping or molding). The window 42 is formed of a transparent or translucent plastic material. In one embodiment, the entire insert 12 is formed of a transparent or translucent plastic material.

With continued reference to FIGS. 3-5, the raised panel 40 receives a swatch 48 that displays a sample of the design of the appliqués 18 contained within the insert 12 and package 10. The swatch 48 is sized and shaped so as to be inserted into the hollow interior 41 of the raised panel 40 from the cavity 44. The swatch 48 is secured in the hollow interior 41, e.g., by adhesive or other attachment means, such that the interior space 43 of the window 42 imposes a distance between the swatch 48 and window 42 (see FIG. 6). Once secured in the hollow interior 41, the swatch 48 is visible through the transparent or translucent plastic of the window 42. Further, the swatch 48 conceals the contents of the cavity 44 of the insert 12 (i.e., the packet 16 of appliqués 18 and the implement envelope 20 (see FIG. 5)).

In another embodiment, the window 42 is sized and shaped to receive a sample nail appliqué or swatch in its interior space 43, rather than the swatch 48 received within the raised panel 40. In yet another embodiment, an appliqué is affixed to an outside surface of the window 42. In both of the foregoing embodiments, the sample nail or swatch conceals the contents of the cavity 44 of the insert 12 (i.e., the packet 16 of appliqués 18 and the implement envelope 20).

Figure 6:
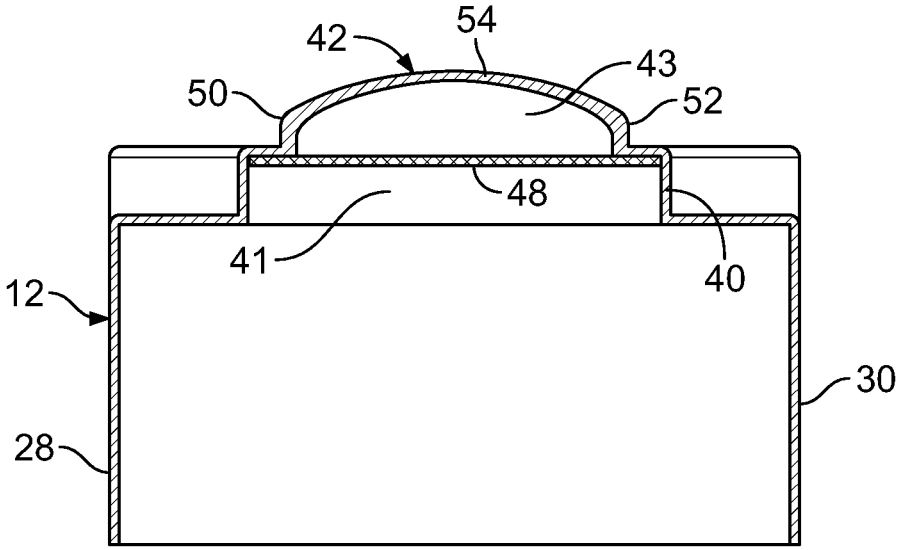
FIG. 6 is a cross-sectional view of the insert illustrated in FIG. 3, as taken along section line 6-6 in FIG. 3.

Referring now to FIG. 6, the surface of the window 42 is convex in shape, having opposed side edges 50, 52 proximate the raised panel 40, and a central apex 54 that is between and substantially equidistant to the side edges 50, 52. As illustrated in the cross-sectional view of FIG. 6, the material (i.e., a transparent or translucent plastic) does not have a uniform thickness across the surface of the window 42. More particularly, the material is thicker at the side edges 50, 52, and gets thinner as it approaches the apex 54, which is the thinnest portion of the window 42. As also illustrated in FIG. 6, the internal space 43 of the window 42 imposes a distance between the swatch 48 and the window 42. The non-uniform thickness of the window 42, the convex shape of the window 42 and/or the internal space 43 distance between the swatch 48 and the window 42 create an enhanced optical effect wherein the two-dimensional swatch 48 contained within the raised panel 40 will appear three-dimensional to a viewer seeing it through the window 42. As the surface of the window 42 is convex and substantially ellipsoid in shape, it possesses the approximate curvature and dimensions of a fingernail. The optical effect created by one or more of the three foregoing structural features thereby affords customers a three-dimensional visual representation of the appliqués 18 (as represented by the swatch 48) when applied to a customer's fingernails.

Referring now to FIG. 5, the insert 12 functions as a container for the packet 16 of appliqués 18 and the implement envelope 20, as such items are stored within the cavity 44 (not explicitly shown in FIG. 5). Additional items may also be contained in the cavity 44, such as instructions for use and promotional literature. The packet 16 is closed with an air-tight seal in order to maintain the quality of the appliqués 18 therein, i.e., to prevent the appliqués 18 from drying out before the package 10 containing them is sold and/or the appliqués 18 are used.

In use, the swatch 48 is placed in the hollow interior 41 of the raised panel 40 such that the interior space 43 of the window 42 imposes a distance between the swatch 48 and window 42, as discussed above. The packet 16 of appliqués 18 and the implement envelope 20 are then placed within the storage cavity 44 of the insert 12. The insert 12 is then inserted into the rectangular carton 14 that is sized and shaped to receive the insert 10, as further discussed below.

With reference now to FIGS. 1, 2 and 5, the rectangular carton 14 is configured to receive the insert 12. The carton 14 is preferably made of generally rigid paper material, but any similar material is within the scope of the invention. The carton 14 includes a front wall 56, a rear wall 58 opposite the front wall 56, and opposed side walls 60, 62. The carton 14 further includes a bottom flap 64 and a top flap 66 that extend from the bottom and top ends of the front wall 56, respectively. The carton 14 may also include opposed side flaps 68, 70 that extend from the top ends of the side walls 60, 62, respectively. All of the flaps 64, 66, 68, 70 secure the contents of the package 10 within the carton 14. In one embodiment, the inside dimensions of the carton 14 (i.e., the inner height, or distance between the bottom and top flaps 64, 66; the inner width, or distance between the side walls 60, 62; and the inner depth, or distance between the front and rear walls 56, 58) are incrementally greater than the outer dimensions of the insert 12 (i.e., the height, or distance between the top and bottom walls 32, 34; the width, or distance between the side walls 28, 30; and the depth, or distance between the front wall 26 and the rear opening of the cavity 44), such that the insert 12 fits within the carton 14 (e.g., under tight tolerances), and thereby further secures the insert 12 within the carton 14. In another embodiment, the inside dimensions of the carton 14 (i.e., the inner height, or distance between the bottom and top flaps 64, 66; the inner width, or distance between the side walls 60, 62; and the inner depth, or distance between the front and rear walls 56, 58) are substantially equal to the outer dimensions of the insert 12 (i.e., the height, or distance between the top and bottom walls 32, 34; the width, or distance between the side walls 28, 30; and the depth, or distance between the front wall 26 and the rear opening of the cavity 44), such that the insert 12 fits within the carton 14 (e.g., under tight tolerances), and thereby further secures the insert 12 within the carton 14.

However, because the window 42 extends outwardly from the front wall 26 of the insert, the distance from the window 42 to the rear opening of the cavity 44 is greater than the inner depth of the carton 14 (see FIGS. 2, 5 and 6). The window 42 therefore abuts the inside surface of the front wall 56 proximate the top flap 66 of the carton 14 when the insert 12 is first inserted therein. This interaction between the window 42 and the front wall 56 of the carton is further discussed below.

With continued reference to FIGS. 1, 2 and 5, a cutout, or aperture 72 is formed in the front wall 56 of the carton 22. In one embodiment, the aperture 72 is substantially elliptical in shape, and substantially the same size as the window 42. Alternatively, the substantially elliptical-shaped aperture 72 may be slightly larger than the window 42. The aperture 72 is formed in the front wall 56 of the carton 22 so that it spatially corresponds to the location of the window 42 on the front wall 26 of the insert 12. The window 42 thereby projects through the aperture 72 when the insert 12 is fully inserted into the carton 14, as illustrated in FIGS. 1 and 2. As discussed above, the window 42 enables a customer to see the swatch 48 within the raised panel 40, wherein the visual appearance of the swatch 48 is representative of the appliqués 18 inside the package 10. Moreover, the optical effect provided by the non-uniform thickness of the window 42 affords customers a three-dimensional visual representation of how the appliqués 18 inside the package 10 (as represented by the swatch 48) will appear when applied to a customer's fingernails, as discussed above.

Usage of the package 10 in an embodiment will now be described, with reference to FIG. 5. The components of the package 10 are assembled for shipping, display and purchase. First, the swatch 48 is inserted into the raised panel 40, from the direction of the cavity 44 of the insert 12. The packet 16 of appliqués 18 and envelope 20 of implements are then inserted into the cavity 44 of the insert 12. Once loaded with the foregoing items, the insert 12 is inserted into the carton 14, with the pull tab 46 in its first position (i.e., in which it is substantially perpendicular to the top wall 32). As discussed above, the window 42 extends outwardly from the front wall 26 of the insert and thereby defines a distance between it and the rear opening of the cavity 44 of the insert 12, the distance being greater than inner depth of the carton 14 (see FIGS. 2, 5 and 6). The window 42 is therefore initially pressed down, i.e., pressed towards the front wall 26 of the insert 12, in order to fit it within the carton 14, and thereby insert the insert 12 into the carton 14.

After the initial insertion of the insert 12 (i.e., when the bottom wall 34 and lower front wall portion 38 have been inserted into the carton 14), the window 42 will abut the inside surface of the front wall 56 of the carton 14. As the insert 12 is pushed further into the carton 14 (i.e., towards the bottom flap 64), the window 42 is moved to the location of the aperture 72. Once the window 42 is aligned with the aperture 72, the window 42 "pops up" to project through the aperture 72. At this stage, the swatch 48 is visible through the window 42 from the exterior of the carton 14, as discussed above. Further, the window 42 projecting through the aperture 72 releasably locks the insert 12 in the carton 14, thereby inhibiting its inadvertent removal from the carton 14.

Once the insert 12 has been completely inserted into the carton 14, the pull tab 46 is rotated from its first position to its second position, in which it is substantially parallel to, and overlaps the top wall 32. This second position facilitates closure of the side flaps 68, 70 of the carton 14 over the pull tab 46, and then closure of the top flap 66. A folded-over edge 74 of the top flap 66 is then secured in a space between the side flaps 68, 70 and the rear wall 58 to securely close the carton 14, as is known in the carton art.

A user may access the contents of the package 10 by first pulling the top flap 66 of the carton 14 open, and then pulling the side flaps 60, 62 open to expose the insert 12. The user then rotates the pull tab 46 of the insert 12 from its second position towards its first position, i.e., away from the top wall 32 of the insert 12. The user then pushes the window 42 down (i.e., towards the rear wall 58 of the carton 14) through the aperture 72 and into the carton 14, which enables the user to pull the insert 12 in a direction away from the bottom flap 64 of the carton 14, and ultimately, out of the carton 14. In other words, compression of the window 42 allows the insert 12 to fit through the carton 14 during the extraction of same. Once the insert 12 is fully extracted from the carton 14, the packet 16 of appliqués 18 and envelope 20 of implements may be removed from the cavity 44 of the insert 12 for use.

It will be understood that the embodiments described herein are merely exemplary and that a person of ordinary skill in the art may make many variations and modifications without departing from the spirit and scope of the invention. All such variations and modifications are intended to be included within the scope of the invention as defined in the appended claims.

What is claimed is:

1. A package comprising:

a carton having opposed top and bottom flaps defining a carton inner height therebetween, opposed side walls defining a carton inner width therebetween, and opposed front and rear walls defining a carton inner depth therebetween, said front wall defining an aperture therein;

an insert sized and shaped to fit inside said carton, said insert having opposed top and bottom walls defining an insert height therebetween, opposed side walls defining an insert width therebetween, a front wall extending between said insert side walls, and a rear opening opposite said insert front wall, said insert front wall having an upper portion, a lower portion, and an intermediate portion therebetween, wherein upper, intermediate and lower depths are defined by a distance between the rear opening and upper, intermediate and lower portions, respectively, a window projecting outwardly from said intermediate portion, said window sized and shaped substantially similar to the aperture;

wherein said carton inner depth is substantially equal to at least said insert upper depth, such that said insert fits within said carton to thereby secure said insert within said carton;

wherein said window projects through said aperture when said insert is inserted into said carton;

wherein an object contained inside said insert is displayed through said window;

wherein said insert includes a raised panel projecting outwardly from said front wall of said insert proximate said window such that said window projects outwardly from said raised panel;

wherein said object is disposed within said raised panel; and, further comprising nail polish appliqués positioned in said insert, said object being a two-dimensional swatch that displays a design corresponding to a design of said nail polish appliqués.

2. The package of claim 1, wherein said window has two opposed side edges proximate said raised panel and a central apex between and substantially equidistant to said side edges, said side edges having a first thickness and said central apex having a second thickness that is less than said first thickness, whereby an enhanced optical effect is created in connection with said swatch.

3. The package of claim 1, wherein said window has a convex shape that provides an enhanced optical effect in connection with said swatch.

4. The package of claim 1, wherein said window defines an internal space that imposes a distance between said swatch and said window, whereby an enhanced optical effect is created in connection with said swatch.

5. A package comprising:

a carton having opposed top and bottom flaps defining a carton inner height therebetween, opposed side walls defining a carton inner width therebetween, and opposed front and rear walls defining a carton inner depth therebetween, said front wall defining an aperture therein;

an insert sized and shaped to fit inside said carton, said insert having opposed top and bottom walls defining an insert height therebetween, opposed side walls defining an insert width therebetween, a front wall extending between said insert side walls, and a rear opening opposite said insert front wall, said insert front wall having an upper portion, a lower portion, and an intermediate portion therebetween, wherein upper, intermediate and lower depths are defined by a distance between the rear opening and upper, intermediate and lower portions, respectively, a window projecting outwardly from said intermediate portion, said window sized and shaped substantially similar to the aperture;

wherein said carton inner depth is substantially equal to at least said insert upper depth, such that said insert fits within said carton to thereby secure said insert within said carton;

wherein said window projects through said aperture when said insert is inserted into said carton;

wherein an object contained inside said insert is displayed through said window;

wherein said object is disposed inside said window; and, further comprising nail polish appliquës positioned in said insert, said object being a sample nail polish appliqué that displays a design corresponding to a design of said nail polish appliqués.

6. The package of claim 5, wherein said insert is made from a flexible material.

7. The package of claim 6, wherein said carton inner height is substantially equal to said insert height, and wherein said carton inner width is substantially equal to said insert width.

8. The package of claim 7, wherein said window extends outwardly from said front wall of said insert, thereby defining a distance between said window and said rear opening, said distance being greater than said inner depth of said carton, whereby said window releasably locks said insert in said carton when said window projects through said aperture, thereby inhibiting the inadvertent removal of said insert from said carton.

9. A method of assembling a package, comprising the steps of:

providing a carton having a bottom flap and a front wall connected to said bottom flap, said front wall defining an aperture therein;

placing at least one object inside an insert, said insert having a front wall and a window projecting outwardly from said front wall of said insert, said insert sized and shaped to fit inside said carton, said insert having opposed top and bottom walls defining an insert height therebetween, opposed side walls defining an insert width therebetween, said front wall extending between said insert side walls, and a rear opening opposite said insert front wall, said side walls being substantially planar and extending between the insert front wall and the rear opening, said window projecting outwardly from said insert front wall, said window sized and shaped substantially similar to the aperture;

inserting said insert into said carton such that said window projects through said aperture; and wherein said at least one object is a swatch displaying a design corresponding to a design of nail polish appliqués to be inserted in said insert, wherein said placing step includes the step of positioning said swatch proximate said window such that it is displayed through said window.

10. The method of claim 9, wherein said inserting step includes the steps of pressing said window towards said front wall of said insert, pushing said insert towards said bottom flap of said carton, moving said window to the location of said aperture, and aligning said window with said aperture such that it projects therethrough.

11. The method of claim 9, wherein said insert includes a raised panel projecting outwardly from said front wall of said insert proximate said window such that said window projects outwardly from said raised panel, and wherein said positioning step includes placing said swatch inside said raised panel.

12. The package of claim 5, wherein said window and aperture are ellipsoid shape.

13. The package of claim 9, wherein said window and aperture are ellipsoid shape.

* * * * *